United States Patent [19]

Volkert et al.

[11] 4,337,589

[45] Jul. 6, 1982

[54] METHOD OF MAKING HINGED POP-UP ITEMS

[75] Inventors: John K. Volkert, Northfield; Ib Penick, ProspectHeights; Robert B. Volkert, Wilmette, all of Ill.

[73] Assignee: Compak Systems, Inc., Northfield, Ill.

[21] Appl. No.: 165,264

[22] Filed: Jul. 2, 1980

[51] Int. Cl.[3] ..... G09F 1/10

[52] U.S. Cl. ..... 40/124.1; 46/34

[58] Field of Search ..... 40/124.1, 120, 152.1, 40/539; 46/34, 35

[56] References Cited

U.S. PATENT DOCUMENTS

| | | | |
|---|---|---|---|
| 1,182,077 | 5/1916 | Colucci | 46/34 |
| 1,545,141 | 7/1925 | Heiss | 46/34 |
| 1,844,816 | 2/1932 | Brown | 40/124.1 X |
| 2,151,299 | 3/1939 | Arndt | 40/124.1 X |
| 2,544,783 | 3/1951 | Freedman et al. | 40/124.1 X |
| 2,742,723 | 4/1956 | Klein et al. | 40/124.1X |
| 3,183,622 | 5/1965 | Frankl | 46/34 |
| 3,235,988 | 2/1966 | Paige | 46/34 |
| 4,103,444 | 8/1978 | Jones et al. | 46/34 |

*Primary Examiner*—Gene Mancene
*Assistant Examiner*—Wenceslao J. Contreras
*Attorney, Agent, or Firm*—Fitch, Even, Tabin, Flannery & Welsh

[57] ABSTRACT

Printed paper novelty items including one or more "pop-ups" and methods for making such items designed for mass production. Promotional items of this type are formed by folding a sheet material blank so that portions constituting pop-up panels are superimposed on portions constituting basepieces. Subsequent folding operation is carried out to sandwich the pop-up panels between the basepieces and to effect adhesive attachment by earlier applied adhesive patterns, and thereafter at least one of the basepieces may be cut to eliminate an original connection between it and a pop-up panel. In the final construction, the basepieces are hinged to each other along a straight line, and each of the pop-up panels is pivotally attached to one of the basepieces along a line at an angle between about 15° and about 70° to the hinge line. The method may be carried out as a part of an overall web press operation or may be carried out through the use of folding machines or through a combination of both.

13 Claims, 12 Drawing Figures

INVITATION

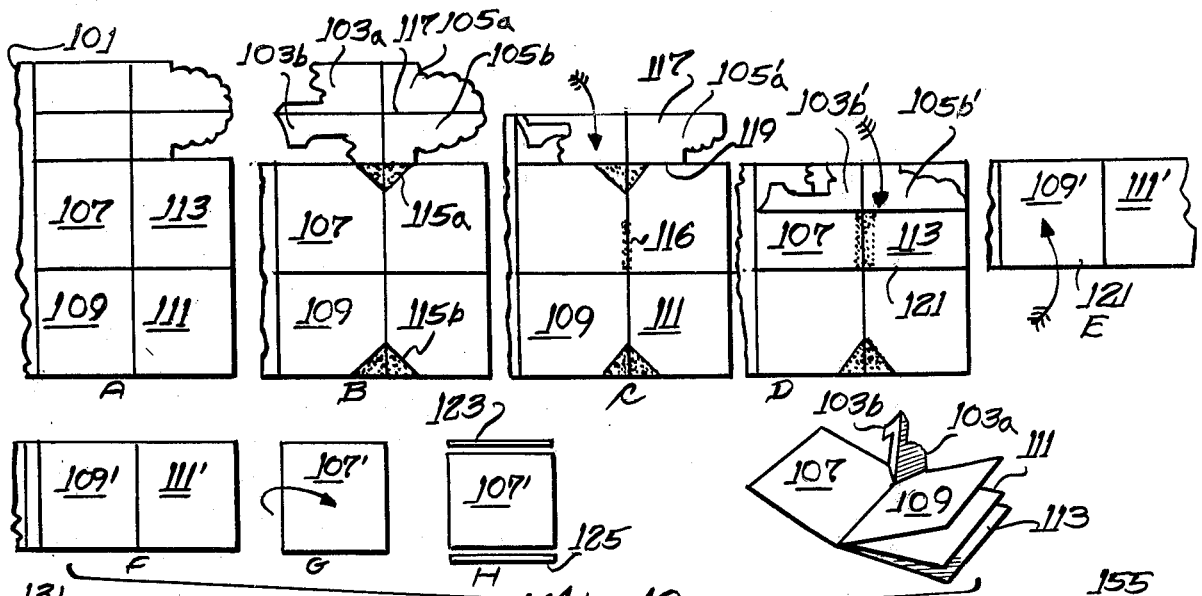
Fig. 10.
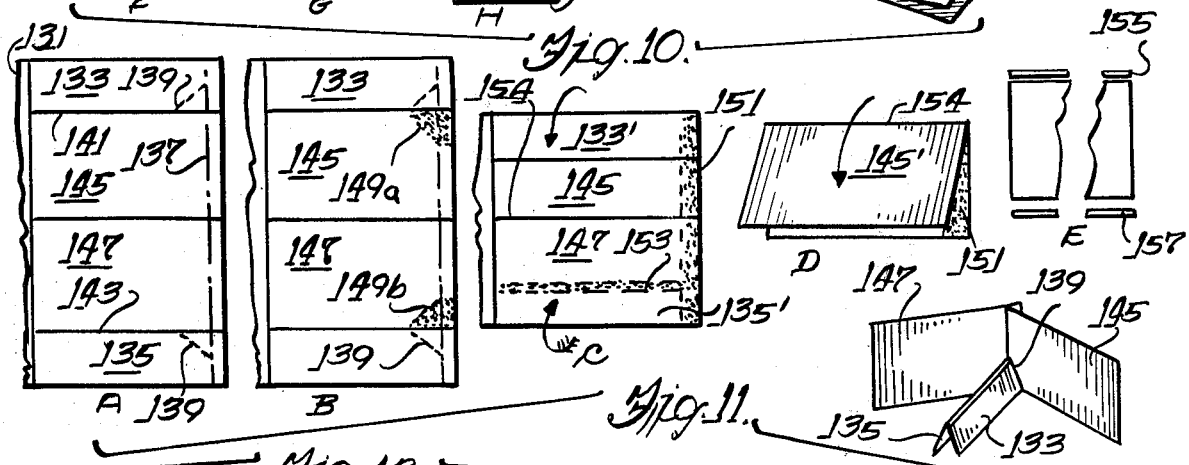
Fig. 11.
Fig. 12.
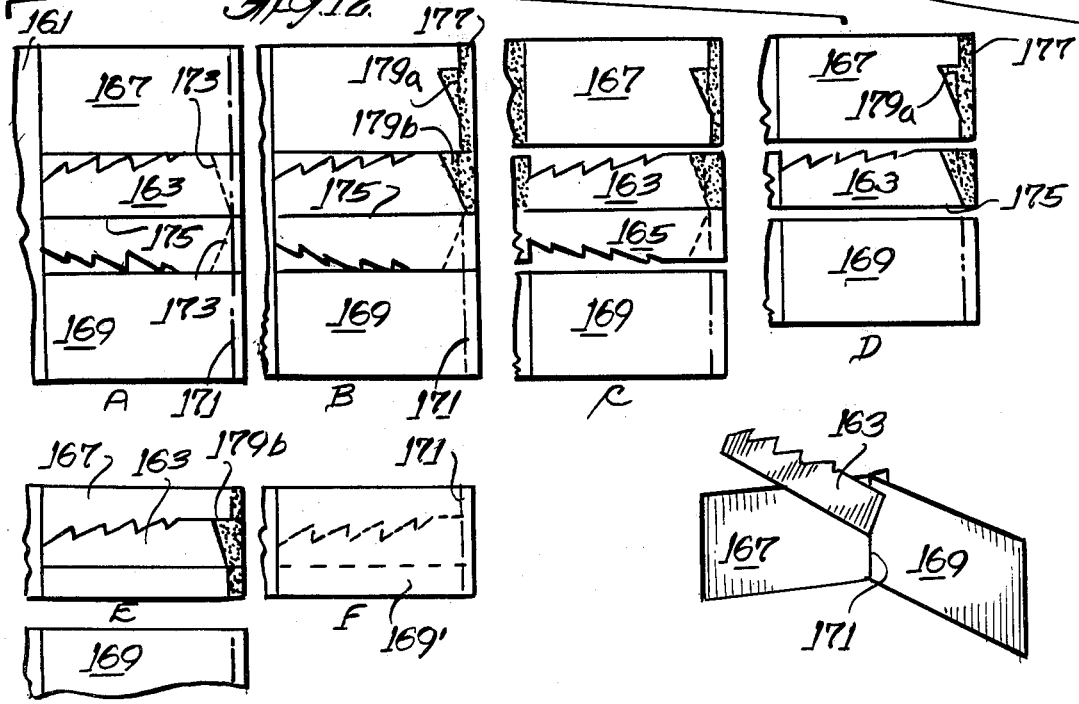

METHOD OF MAKING HINGED POP-UP ITEMS

BACKGROUND OF THE INVENTION

This invention relates to printed paper novelty items of various types, and more particularly to methods of making dimensional and specialty paper products of this general character wherein a "pop-up" is provided.

The invention is especially directed to the creation of promotional pieces wherein a pop-up is provided between the facing pages of a folder which, upon the opening of the folder, generally moves upward and outward of the plane of the folder pages and more particularly to methods designed to facilitate economical mass production of such items. U.S. Pat. No. 3,995,388, issued Dec. 7, 1976, discloses methods for making pop-up paper products having significant advantages over hand-assembly methods generally theretofore employed for the production of such products. U.S. Pat. No. 4,146,983, issued Apr. 3, 1979, discloses methods for making other novel promotional items, particularly such which are designed to present a plurality of coupons to the receipient upon the opening of a folder.

Development work has continued with respect to adapting pop-up items of this general type to economical mass production, particularly as a part of an overall web-press operation.

SUMMARY OF THE INVENTION

The present invention provides designs for improved promotional pop-up items of this general character which are particularly adapted for fabrication by mechanical mass production, for example, as a part of a web-press operation. The improved methods produce an item from a single blank of sheet material having a pop-up assembly in the form of at least two interconnected panels, each of which is respectively joined to the interior surface of one of two base-pieces that are pivotally connected to each other and constitute a folder. The joinder may be simply achieved by adhesive connection in a triangular region or its equivalent so that each pop-up panel is effectively hinged to the interior surface of one basepiece along a line at a particular acute angle to the fold line of the folder, and an original fold-line connection between a pop-up panel and a basepiece is then severed. Opening of the folder causes the pop-up panels to rise up out of the plane of the basepieces in an attention-attracting fashion. The interconnections between the panels of the pop-up assembly can take a variety of forms; however, the relatively simple concept of folded construction facilitates fabrication by mass production methods, e.g. as part a of an overall web-press operation.

BRIEF DESCRIPTION OF THE DRAWINGS

FIG. 10 is a schematic view illustrating one manner in which a promotional item embodying various features of the invention might be produced as a part of a web-press operation; and FIGS. 11 and 12 are schematic views similar to FIG. 10 of alternative embodiments of production-line arrangements for fabricating items of this general type.

DETAILED DESCRIPTION OF THE PREFERRED EMBODIMENTS

Figures 1, 2, 2A, 3, 4, 5, 5A, 6, 7, 8, 8A, 9:
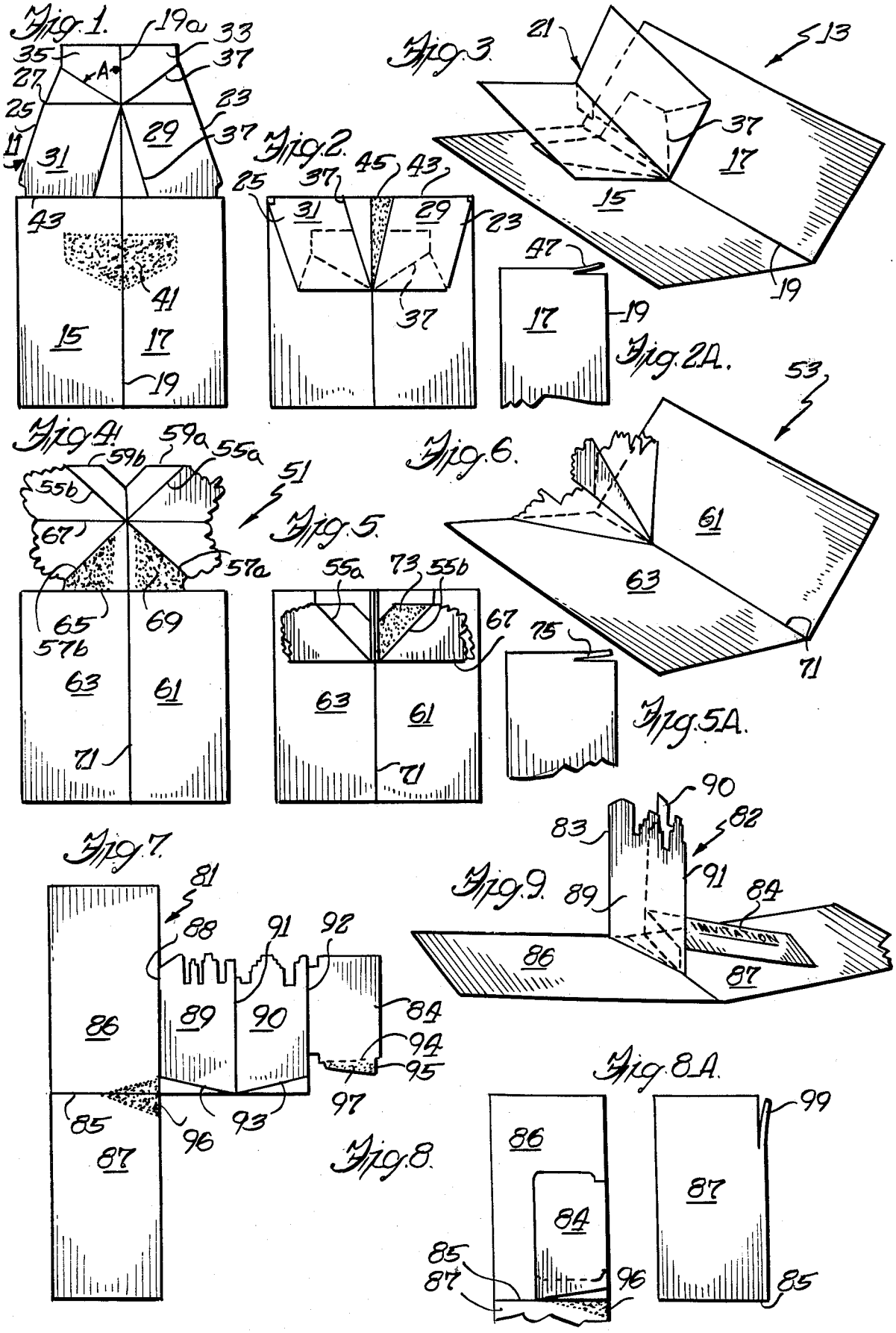
FIG. 1 is a plan view of a blank showing a promotional item embodying various features of the invention.
FIGS. 2 and 2A are views of the blank of FIG. 1 in different folded conditions.
FIG. 3 is a perspective view of a promotional item formed from the blank of FIG. 1 in its completely fabricated condition.
FIG. 4 is a plan view of a blank for forming an alternative embodiment of a promotional item.
FIGS. 5 and 5A are views of the blank of FIG. 4 in different folded conditions.
FIG. 6 is a perspective view of the promotional item formed from the blank of FIG. 4 in its completely fabricated condition.
FIG. 7 is a plan view of a blank for forming still another alternative embodiment of a promotional item.
FIGS. 8 and 8A are views showing the item of FIG. 7 in different folded conditions.
FIG. 9 is a perspective view of the promotional item formed from the blank of FIG. 7 shown in its completely fabricated condition.

A blank 11 is shown in FIG. 1 designed for the formation of a promotional item or piece 13 as illustrated in FIG. 3. The piece 13 includes a pair of basepieces 15 and 17 which are hinged along a central fold line 19. Located between the basepieces is a pop-up assembly 21 which, in the folded condition, lies substantially flat and hidden between the base-pieces 15, 17 that constitute a folder, however, when the folder is opened, the pop-up assembly 21 rises out of the plane of the basepieces. In the illustrated item 13, the pop-up assembly 21 is structured and preferably printed to resemble the pages of an open book.

The pop-up assembly 21 is formed from a right-hand panel 23 and a left-hand panel 25 which are mirror images of each other and which, as best seen in FIG. 1, are hinged to each other along a line 19*a* that is an extension of the centerline 19 between the base-pieces 15,17. The pop-up panels 23,25 are individually folded upon themselves in the fabrication procedure along a transverse line 27 which is perpendicular to the centerline extension 19*a*, thereby dividing the two pop-up panels each into a pair of subpanels, i.e., a display subpanel 29,31 and a support subpanel 33,35. When the blank 11 is die-cut, a press score 37 is preferably created in each of the four subpanels. The press scores 37 in the support subpanels 35,37 are oriented at an angle A to the centerline (see FIG. 1), and the angle A should be between about 15° and about 70°. The press scores 37 in the display subpanels 29,31 render the depiction of the open-book more realistic in its final fabricated form shown in FIG. 3.

The steps in the fabrication process for making the promotional piece 13 are illustrated in FIGS. 1,2 and 2A wherein FIG. 1 shows an adhesive pattern 41 which has been applied to the basepieces 15,17 having a shape and a location so as to affix certain minor portions of the pop-up panels 23,25 to the basepieces. More specifically, the adhesive pattern 41 has the shape of the minor portions of both of the panels which lie above the press score lines 37 in the support subpanels 33,35. The blank 11 is then folded along the transverse line 27 so that each one of the pop-up panels 23,25 is folded upon itself. The pre-folded pop-up panels 23,25 are then folded again along a transverse line 43 along which they are originally connected to the upper edges of the basepieces 15,17—arriving at the configuration shown in FIG. 2. Depending upon the particular folding mechanism that is employed, it may be desirable to make the first fold along the transverse line 27 before applying the main adhesive pattern 41.

A second adhesive pattern 45 is then applied to one or both of the regions of the display subpanels 29,31 lying between the centerline 19*a* and the press scores 37. This pattern 45 serves to unite these two portions of the subpanels 29,31 in surface-to-surface contact with each other in the final fabricated piece and enhance the "open-book" effect. Folding is then effected along the centerline 19, and compression may be applied to complete the adhesive bonds. The fabrication of the piece 13 is then completed by severing the upper edge 47 of the folded construction as depicted in FIG. 2A; alternatively, the edge can be removed while in the configuration shown in FIG. 2 after adhesive 41 has sufficiently set.

Any suitable adhesive can be used in the fabrication process, such as a hot-melt adhesive or a solvent-based adhesive. Moreover, a heat-activated or an ultrasonic-activated adhesive might instead be applied at an earlier time (even before die-cutting) by printing onto a continuous-web from which the blanks are being produced, and in such an instance the adhesive bond is subsequently achieved by subjecting the folded piece to heat or ultrasonic energy, as appropriate, to activate the previously-applied adhesive patterns.

The construction of the completely fabricated piece 13 is such that the pivoting of one of the basepieces 15,17 relative to the other along the natural hinge line 19 causes the pop-up assembly 21 to rise up from the plane of both of the basepieces, as shown in FIG. 3. The regions of the support subpanels 33,35 lying above the press score lines 37, are, of course, fixed in surface-to-surface contact with the interior surfaces of the basepieces 15 and 17 so that the remainder of each pop-up panel 23,25 is hinged to the interior surface of the basepieces 15,17 along the press score lines 37 which lie at an angle of about 60° to the centerline 19. Moreover the display subpanel portions are interconnected to each other by the adhesive pattern 45 to enhance the visual effect. As a result, an attractive, attention-getting promotional piece 13 is easily fabricated from a single blank 11 by a series of folding operations using strategically-applied adhesive patterns 41,45. The pop-up panels 23,25 are maintained precisely in place because of their original hinged interconnection to the basepieces along the transverse line 43 which is preferably severed only after the final folding operation has taken place. Because of these features, the blank 11 is particularly adapted for fabrication by automatic mass production.

Illustrated in FIG. 4 is a die-cut blank 51 which is designed to create a promotional piece 53 that, upon opening, presents a pop-up in the form of a bouquet of flowers. At the time of die-cutting, the blank 51 is preferably press-scored to produce four generally diagonal score lines 55*a* and *b* and 57*a* and *b* in the regions which will become pop-up panels 59*a* and *b*. The two pop-up panels 59*a,b* are originally connected to the remainder of the blank, which forms the basepieces 61 and 63, along a straight line 65. In a manner somewhat similar to the blank 11 shown in FIG. 1, the pop-up panels 59*a,b* are designed to also be folded upon themselves along a line 67 parallel to the original line of connection 65 between the pop-up panels and the basepieces. In this respect, the lower approximately half of the pop-up panels contains the minor regions to be joined to the interior surface of the basepieces, i.e., those lying between the score lines 57*a* and *b* and the line of connection 65.

An adhesive pattern 69 is applied to these generally triangular regions on both sides of the centerline 71 of the blank as shown in FIG. 4 or at least to that part of the regions lying near the score lines 57*a, b,* or alternatively the adhesive pattern can be applied to the corresponding area of the basepieces. The two pop-up panels 59*a,b* are folded along the original line of connection 65 into superimposed position atop the basepieces 61,63, and thereafter the pop-up panels are folded upon themselves along the parallel line 67 arriving at the configuration depicted in FIG. 5. However, if desired, these two folding steps can be reversed by the pop-up panels being first folded upon themselves and then, in this condition, being folded along the line 65 onto the basepieces. In either case, the result is the establishment of an adhesive connection by the pattern 69 between the minor regions of the pop-up panels and the basepieces.

An adhesive pattern 73 is then applied to one or both of the pop-up panels in the region between the diagonal score lines 55*a* and *b* and the centerline 71, and the final folding about the centerline is effected to join the pop-up panels by the adhesive pattern. As depicted in FIG. 5A, the fabrication is completed by trimming the upper edge 75 of the folded assembly to remove the original line of connection 65 between the pop-up panels and the upper edge of the basepieces.

Opening of the folded piece so that the basepieces 61,63 pivot about the centerline 71 causes the two pop-up panels 59*a,b,* which are interconnected by the adhesive pattern and pivotally joined to the basepieces along the diagonal score lines 57*a* and *b,* to rise up and give the impression of an open bouquet of flowers, which impression is aided by the printing appearing upon the sheet material blank 51.

Illustrated in FIG. 7 is a die-cut blank 81 for fabricating still another version of a promotional piece 82 which, in addition to a pop-up assembly 83, includes a separate card 84. For ease in description, it will be assumed that the card 84 is employed as an invitation; however, it should be understood that it could likewise be a coupon or any other printed item, such as a post-paid business reply card. Moreover, by simply adding another panel, a business reply envelope could be easily formed in place of the card.

In the FIG. 7 embodiment, a centerline 85 through the main region, which divides it into two basepieces 86,87, is shown horizontal, and the remainder of the blank 81, which will constitute the pop-up assembly, is hinged along a straight line 88 to the right-hand edge of only the upper basepiece 86. In the illustrated version, pop-up panels 89,90 are die-cut and preferably printed to depict the skyline of a number of high-rise buildings. They are arranged side-by-side with a line of demarcation 91 separating them which is parallel to the original line of connection 88. The portion of the blank 81 which constitutes the invitation is hinged to the pop-up panel 90 along a line of demarcation 92. At the time of die-cutting, a pair of diagonal press score lines 93 are preferably formed in the two pop-up panels 89,90, and a line of perforations 94 is preferably formed in the invitation portion of the blank to create a generally triangular tab 95.

An adhesive pattern 96 is then preferably applied to a triangular region along the centerline 85 of the basepieces which corresponds to the two triangular regions in the pop-up panels lying below the press score lines 93, and another adhesive pattern 97 is applied to the tab portion of the invitation. However, either adhesive pattern could alternatively be applied to the corresponding opposite region on the blank 81.

Following the application of the glue patterns, the three panels 84, 90 and 89 are folded in any suitable sequence so that they are superimposed, one atop the other, upon the upper basepiece 86. For example, the invitation 84 may first be folded along the line 92 onto the right-hand pop-up panel 90, further attaching it thereto by the adhesive pattern 97 on the tab. Next, all three panels may be folded across the basepiece 86 along the original line of connection 88, and finally, the pop-up panel 90 may be folded along the line of demarcation 91 so as to lie atop the other pop-up panel 89. This produces the configuration shown in FIG. 8, and the lower basepiece 87 is then folded along the centerline 85 to lie atop the upper basepiece 86 as depicted in FIG. 8A, so that the triangular glue pattern 96 affixes the minor triangular regions of the pop-up panels 89,90 to the respective basepieces. Finally, as shown in FIG. 8A, the right-hand edge 99 is trimmed, removing the original connections between the upper basepiece 86 and the pop-up panel 89 and between the invitation 84 and the pop-up panel 90 and completing the fabrication.

Opening of the folder 82 causes the basepieces 86,87 to pivot about the centerline 85 and the pop-up assembly to rise directly upward from the plane of the basepieces 86,87. The invitation 84, which is now attached to the pop-up panel 90 only by the tab 95, hangs down along the line of perforations 94 to the position illustrated where it attracts attention of the recipient.

Although the illustrated blanks may be automatically fabricated into promotional items using standard folding and gluing machines, the invention is also capable of performance as a part of a web-press operation. Accordingly, FIGS. 10, 11 and 12 illustrate examples of web-press sequences for fabricating other promotional items embodying various features of the invention.

Illustrated in FIG. 10 is a web-press sequence for producing a promotional item which includes two pairs of basepieces with a pop-up provided between each of the pairs. FIG. 10 is a diagrammatic representation of an automatic fabrication method which starts with a continuous web 101 of sheet material. Individual stations in the web-press operation are labeled as A through H, and the web is broken between the stations for ease in illustration.

At Station A, the web 101 is die-cut and may be provided with press-scoring in the region of the pop-up panels 103*a,b* and 105*a,b;* however, depending upon the flexibility of the paper and the effect which it is desired to achieve, the press-scoring may be omitted and an adhesive connection may be solely relied upon to define the lines along which the pop-up panels will remain ultimately pivotally joined to the surfaces of the basepieces 107, 109, 111 and 113. Accordingly, although none of the lines of demarcation between the various basepieces and/or pop-up panels need necessarily be present in the printed web 101, for ease and description they are shown in the FIG. 10 embodiment; however, it should be understood that these lines are created as a result of the folding steps that occur.

At Station B, adhesive patterns 115*a,b* are applied to the blank which cover triangular regions located in a corner of each of the four basepieces, and a short narrow strip 116 of adhesive is also applied. At Station C, a folding operation is effected wherein the top edge portion of the web, which constitutes the region of the pop-up panels 103*a* and 105*a,* is folded 180° along a longitudinal line 117 onto the pop-up panels 103*b* and 105*b.* To aid in understanding the operation, the undersurface of the panels is indicated by the corresponding prime number.

At Station D, a second folding operation takes place whereby the superimposed pop-up panels 103, 105 are simultaneously folded onto the basepieces about the longitudinal line 119 of original connection with the top edges of the basepieces 107, 113. At Station E, the lower portion of the web is folded 180° about the line 121 to superimpose the basepieces 109 and 111 atop the basepieces 107 and 113 with the pop-up panels sandwiched therebetween. As the adhesive sets and creates the bond, the individual pop-up panels 103, 105 becomes respectively joined to one of the basepieces in the triangular regions, and the four basepieces become interconnected by the strip 116 along what will become the backbone.

At Station F, the web 101 is severed transversely to separate one folded item from the next following item. Following the severing, the individual item is folded transversely to the direction of travel of the web in a tucker-blade folder or other suitable type of folding machine at Station G. Finally, the upper and lower edges 123,125 are trimmed at Station H to complete the fabrication and eliminate the original connections which existed between the basepieces along lines in a direction longitudinal to the movement of the web. The final view illustrates the opening of the promotional item with the pop-up formed from the die-cut panels 103*a* and *b* shown projecting upward from the basepieces 107 and 109. It will be understood that the other pop-up formed by panels 105*a,b* appears when the basepieces 111 and 113 are opened by pivoting relative to each other.

FIG. 11 depicts another method for fabricating a promotional piece wherein, instead of relying upon a natural fold line between the pop-up panels and also between the respective basepieces, a so-called "false-backbone" technique is used. FIG. 11 depicts a continuous web 131 which has been appropriately printed and which may be die-cut at Station A to provide the desired shaping for a pair of pop-up panels 133,135 which are located along the upper and lower edges of the web 131. In the illustrated embodiment, die-cutting is not shown; however a transverse press score line 137 and two short press-score lines 139 are impressed. The pop-up panels 133,135 are respectively originally hinged along lines of demarcation 141,143 to the basepieces 145,147.

At Station B, adhesive patterns 149*a* and *b* are applied covering triangular regions in the corners of the basepieces 145,147 adjacent the pop-up panels and also extending into the leading edge portion of the individual blank portion which will ultimately become the false backbone. At Station C, a folding operation occurs wherein the pop-up panels 133,135 are respectively folded about the lines of demarcation which are parallel to the longitudinal movement of the web so as to superimpose them respectively upon the underlying basepieces 145,147. At Station C, a strip of adhesive 151 is also applied along the entire leading edge of the individual blank edge; however, it should be understood that the adhesive pattern 151 could stop at the centerline and thus cover only the upper half or only the lower half, if desired. An adhesive pattern 153 is also applied along the upper edge of the lower pop-up panel 135.

At Station D, the final folding step takes place wherein the upper basepiece 145 is folded about the centerline 154 so as to be superimposed atop the lower basepiece 147 with the pop-up panels sandwiched therebetween. As a result of this folding step, the adhesive pattern 151 creates a false backbone along the leading or righthand edge of the item, and the adhesive pattern 153 creates an interconnection between the two pop-up panels 133,135 along a line parallel to the direction of travel of the web 131. At Station E, the upper and lower edges 155,157 of the web are trimmed, and the web 131 is cut transversely to sever the completed item from the next item in line. The trimming operation at the upper edge 155 separates the original connection between the basepieces 145,147 along the centerline 154, and the severing of the lower edge 157 of the web eliminates the hinged connections between each of the pop-up panels 133,135 and its respective basepiece.

The final view shows the promotional piece as it would appear to a recipient after opening by pivoting the basepieces 145,147 relative to each other along the score line 137 that defines the false backbone. The pop-up panels 133,135 are attached to each other by the adhesive pattern 153 along their upper edges thereof, and the adhesive pattern 149 in the triangular regions joins the corners of each pop-up panel respectively to a corner of one of the basepieces. As a result, when the basepieces 145,147 are opened, the pop-up panels pivot along the score lines 139 to extend outward from the planes of the basepieces. The angle at which the individual lines of pivot of the pop-up panels are disposed affects the movement during opening and, the greater the acute angle is between this pivot line 139 and the line 137 of pivotal movement between the basepieces, the further the pop-up panels will pivot during the opening movement. For example, as the angle in the illustrated embodiment approaches 45°, when the basepieces are opened 180° as depicted, the pop-up will extend well below the region of the basepieces and will approach an orientation in which it nearly returns to the flat plane of the opened basepieces.

FIG. 12 depicts still another method for fabricating a promotional piece wherein a false-backbone technique is employed. In the FIG. 12 configuration, a continuous web 161 is die-cut and scored at Station A to provide the desired shaping for a pair of pop-up panels 163,165 which are located centrally of the web between portions that will ultimately become basepiece 167 and 169. A transverse press scoreline 171 and two short, angular, press scorelines 173 are also formed at Station A. The pop-up panels 163,165 are hinged to each other along the centerline 175 of the web. At Station B, an adhesive pattern 177 is provided along the leading edge portion of each individual blank in the upper half of the region which will ultimately become the false backbone. A pair of triangular adhesive patterns 179*a* and *b* are also applied at the locations illustrated.

At Station C, a slitting operation occurs wherein the portion of the web constituting the basespiece 167 and the portion of the web constituting the basepiece 169 are both separated from the center portion of the web forming the pop-up panels 163,165. At Station D, the central portion of the web is folded along the centerline 175 so as to superimpose the pop-up panel 163 onto the pop-up panel 165 by folding the lower half of the center ribbon thereunder.

At Station E, the folded central portion of the web is shifted upward so as to centrally overlie the portion of the web constituting the basepieces 167 and brought into abutting contact therewith so that contact is achieved in the region of the false backbone by the adhesive pattern 177 and also in the triangular region to the right of the score line 173 by means of the adhesive pattern 179*a*.

At Station F, the lower portion of the web constituting the basepiece 169 is shifted upward and aligned with the portion of the web constituting the basepiece 167, thereby sandwiching the pop-up panels 163,165 between the basepieces 167,169 as depicted at Station F. The undersurface of the panel 169 becomes adhesively attached in the backbone region by the adhesive pattern 177 and in the triangular region by the pattern 179*b* on the pop-up panel 163. Thereafter, the superimposed web is cut transversely to sever the completed item from the next item in line, thereby completing the fabrication.

The final view shows the promotional piece as it would appear to a recipient after opening by pivoting the basepieces 167,169 relative to each other along the score line 171 that defines the false backbone. The pop-up panels 163,165 are located generally centrally of the basepieces as opposed to being either at the top or bottom edges, and the thus the pop-up structure appears to rise up from the center of the folder which is constituted by the hinged basepieces.

Although the invention has been described with regard to certain preferred embodiments which constitute the best modes presently known to the inventors, modifications and changes as would be obvious to one having the ordinary skill in this art may be made to the illustrated structures and methods without deviating from the scope of the invention that is defined in the appended claims. For example, certain of the steps can be performed in different sequences while accomplishing the same end result. Although the configurations shown in FIGS. 10 and 11 are advantageously fabricated as a part of an overall web-press operation, they may also be performed on folding machines. In the FIG. 12 embodiment, the adhesive pattern 179*b* could be applied to the basepiece 169 and later that ribbon could be turned 180° to effect the sandwiching. Although adhesive joinder is preferred as the most practical approach, it should be recognized that known equivalent methods of attachment, e.g., stapling, crimping, interlocking, might alternatively be used for certain of the joining operations without departing from the invention.

Various features of the invention are emphasized in the claims which follow.

What is claimed is:

1. A method of making an item of the character described comprising forming a blank from sheet material which blank includes a pair of basepieces and a pair of pop-up panels, at least one of which pop-up panels is originally connected along a straight line to one of said basepieces, applying an adhesive pattern to said sheet material blank, folding said sheet material blank so that said pop-up panels are superimposed upon the portion of said blank constituting said basepieces and subsequently folding said blank along a straight line to bring said basepieces into superimposed position with said pop-up panels sandwiched therebetween, whereby a minor region of each of said pop-up panels becomes respectively adhesively attached to one of said basepieces, and cutting one common edge of at least one of said basepieces and said one pop-up panel following said adhesive attachment to eliminate said original connection between said one pop-up panel and said one basepiece so as to free said edge of said one pop-up panel to allow said edge to move away from said one basepiece, whereby said basepieces are hingedly interconnected along a straight line with said pop-up elements sandwiched therebetween and with each of said pop-up panels being pivotally attached to one of said basepieces generally at an angle of between about 15° and about 70° to said line of hinged interconnection so that the pivoting of said basepieces about said line of hinged interconnection to an open position causes said pop-up panels to rise up out of the plane of each of said basepieces with said edge of said one pop-up panel moving away from said one basepiece edge.

2. A method in accordance with claim 1 wherein said blank is formed so that said basepieces are adjacent each other and said adjacent edges form said line of hinged interconnection upon folding.

3. A method in accordance with claim 1 wherein said blank is formed so that said pop-up panel is originally connected to said basepiece along a hinge line generally perpendicular to said line of hinged interconnection.

4. A method in accordance with claim 1 wherein said blank is formed so that each of said pop-up panels is originally respectively connected to one of said basepieces.

5. A method in accordance with claim 1 wherein said blank is formed so that one of said pop-up panels is originally connected along one edge to only one of said basepieces and is connected along a parallel edge to said other pop-up panel.

6. A method in accordance with claim 2 wherein said adhesive pattern is located and shaped to produce a generally right triangular region of attachment, the hypotenuse of which forms said angle which is between about 15° and about 45°.

7. A method in accordance with claim 1 wherein each of said pop-up panels is folded upon itself generally along a line parallel to said original line of connection prior to said cutting step.

8. A method in accordance with claim 1 wherein said blank is formed so that said pop-up panels are arranged in flanking location to said pair of basepieces, wherein said cutting step severs both parallel edges of said basepieces and said adhesive pattern creates a false backbone along an edge perpendicular to said parallel edges.

9. A method in accordance with claim 8 wherein said adhesive pattern also creates an interconnection between said pop-up panels along an edge parallel said line of original connection.

10. A method in accordance with claim 1 wherein said sheet material blank is a part of a continuous web during the time when said forming, adhesive applying and folding steps are carried out.

11. A method of making an item of the character described comprising providing a web of sheet material which is printed to constitute a series of blanks, each of which includes a pair of basepieces and a pair of pop-up panels, which pop-up panels are connected along a straight line to each other, applying a predetermined adhesive pattern to said sheet material web in the region of each blank, cutting said sheet material web to form three ribbons containing, respectively, one of said basepieces, the other of said basepieces, and said pair of pop-up panels, folding said pop-up panels ribbon so that said pop-up panels are superimposed upon each other, superimposing said folded ribbon upon said ribbon constituting one of said basepieces and aligning it therewith so that a minor region of the lower of said superimposed pop-up panels becomes adhesively attached to said basepiece by said adhesive pattern, and superimposing said remaining ribbon atop said folded pop-up panels ribbon to sandwich said pop-up panels between said basepieces and adhesively attach said other pop-up panel to said other basepiece and to adhesively attach said basepieces to each other, and cutting said superimposed ribbons transversely following said adhesive attachment to create individual items with said basepieces being hingedly interconnected along a straight line, with said pop-up panels being pivotally attached by said predetermined adhesive pattern to one of said basepieces at an angle of between about 15° and about 70° to said line of hinged interconnection so that the pivoting of said basepieces about said line of hinged interconnection to an open position causes said pop-up panels to rise up out of the plane of each of said basepieces.

12. An item of the character described comprising a pair of basepieces hinged together along a generally straight line so that one can be pivoted relative to the other to an open position, a pop-up located between said basepieces including at least a pair of panels which are interconnected to each other, each of said pop-up panels being folded upon itself generally along a line perpendicular to said basepiece hinge line, and means joining a minor region of each of said panels respectively to one of said basepieces so that each said panel is pivotally connected to a basepiece along a line at an angle of between about 15° and about 70° to said hinge line, whereby the pivoting of said basepieces to the open position causes said pop-up to rise up out of the planes of said basepieces.

13. An item in accordance with claim 12 wherein said basepieces and said pop-up panels are formed from an integral sheet and wherein said pop-up panels are interconnected to each other along a hinge line which in the closed position is generally perpendicular to said basepiece hinge line.

* * * * *